United States Patent [19]

Horn

[11] 4,444,375

[45] Apr. 24, 1984

[54] HUNTER'S TOWING MACHINE

[76] Inventor: Earl E. Horn, 2910 G St., Eureka, Calif. 95601

[21] Appl. No.: 378,906

[22] Filed: May 17, 1982

Related U.S. Application Data

[63] Continuation-in-part of Ser. No. 077,025, Sep. 19, 1979, abandoned.

[51] Int. Cl.[3] ..... B66D 3/18

[52] U.S. Cl. ..... 254/346; 104/173 ST; 254/358; 254/356; 254/355

[58] Field of Search ..... 254/342, 346, 355, 356, 254/358, 365, 366, 370, 375; 104/173 ST

[56] References Cited

U.S. PATENT DOCUMENTS

| | | | |
|---|---|---|---|
| 2,869,822 | 1/1959 | Shurtliff | 254/358 |
| 2,930,585 | 3/1960 | Reeves | 254/358 |
| 3,088,709 | 5/1963 | Hunt . | |
| 3,197,162 | 7/1965 | Johanson et al. | 254/358 X |
| 3,307,494 | 3/1967 | Samitz . | |
| 3,473,486 | 10/1969 | Harmon | 104/173 ST |
| 3,618,898 | 11/1971 | Notestine | 254/346 X |
| 3,653,606 | 4/1972 | Sheets . | |
| 3,692,119 | 9/1972 | Tucker | 104/173 ST X |
| 3,739,728 | 6/1973 | Thompson . | |
| 3,776,515 | 12/1973 | Bergeron . | |
| 3,829,064 | 8/1974 | Jackson . | |
| 3,938,781 | 2/1976 | Craven et al. | 254/342 |
| 4,118,013 | 10/1978 | Christison et al. | 254/356 X |
| 4,162,059 | 7/1979 | Fletchall | 254/375 X |

*Primary Examiner*—John M. Jillions

*Attorney, Agent, or Firm*—Blair, Brown & Kreten

[57] ABSTRACT

An adapter that converts any normal chainsaw into a winching type towing machine for use by hunters who fell large game such as elk or deer, and must haul their fallen prey over rugged and remote terrain. The adapter replaces a chainsaw chain and guide bar, and bolts into the same position. The adapter comprises a drive chain and housing with a cable guide bar in the front and a tow bar in the rear. The housing contains a drive sprocket connected to a cable drum via a transmission that engages or disengages the drive train. An automatic braking system prevents the cable drum from paying out cable when under a load which may occur when the chainsaw motor is idling and a centrifugal clutch has disengaged the drive power. The adapter folds up into a compact unit capable of being transported anywhere. Additionally, the invention is not limited to use by hunters, but may be used whenever a motorized winching operation is called for.

8 Claims, 8 Drawing Figures

HUNTER'S TOWING MACHINE

CROSS REFERENCE TO RELATED APPLICATIONS

This is a continuation in part of Ser. No. 077,025, filed Sept. 19, 1979, and now abandoned.

BACKGROUND OF THE INVENTION

A hunter tracking an elk, a deer, or other such animal, must often follow his prey to remote areas over rugged terrain. If the huntsman is successful, he must retrieve his fallen prey before scavangers attack the carcass. Retrieving the prey from a remote and rugged area is an arduous task that requires assistance, especially if the area is inaccessible to a motorized vehicle. Therefor, a need exists for a lightweight portable towing device that a huntsman can pack with him into remote areas to aid him in dragging his fallen prey over snow covered hills and other rugged terrain.

The following references would appear to be germane to the patentability of the present invention:

U.S. Pat. No. 3,088,709 Hunt; U.S. Pat. No. 3,692,119 Tucker;

U.S. Pat. No. 3,307,494 Samitz; U.S. Pat. No. 3,739,728 Thompson;

U.S. Pat. No. 3,473,486 Harmon; U.S. Pat. No. 3,776,515 Bergeron;

U.S. Pat. No. 3,653,606 Sheets, Jr.; U.S. Pat. No. 3,829,064 Jackson.

The references cited define a plethora of towing and winching type devices. None of them defines an adapter for a chainsaw to provide a towing machine. Furthermore, none of them employs a structure similar to the present invention.

SUMMARY AND OBJECTS OF THE INVENTION

Accordingly, it is an object of the present invention to provide a chainsaw adapter that converts a normal chainsaw into a hunter's towing machine. This is accomplished in the present invention by providing a housing with skids that bolts onto a chainsaw replacing the chainsaw blade and the chain. The adapter employs a cable wound on a drum in conjunction with a special drive fitted to the chainsaw and connected to the drive sprocket contained in the adapter. The hunter pays out the cable and attaches it to a secure distant object such as a tree, and then he attaches his prey to the rear of the adapter with a tow line and uses the chainsaw motor to gradually rewind the cable on the cable drum.

It is a further object of the present invention to provide dependable means to tow objects at a controllable rate. This is accomplished by utilizing the variable speed throttle control of the chainsaw in conjunction with the centrifugal clutch of the chainsaw. Varying the speed at which the chainsaw motor runs controls the rate that the cable is wound on the cable drum of the adapter.

Likewise, it is a further object of the present invention to provide a braking system that prevents the force of the load from unwinding the cable from the cable drum during a pause in the towing process when the chainsaw is idling and the centrifugal clutch in the chainsaw is disengaged. This is accomplished by an automatic brake that engages a friction pad on the drive sprocket as soon as the drive sprocket attempts to reverse direction. The present invention is also provided with an auxiliary, manually operated brake system.

It is a further object of the present invention to provide a clutch mechanism in the adapter that allows the chainsaw to be started and revved up before the drive train is manually engaged. This is accomplished by employing a transmission system involving a main shaft that co-acts with a spur gear on an intermediate shaft. A manually operated positive lug type clutch on the intermediate shaft engages the spur gear which then drives the intermediate shaft. A pinion gear on the intermediate shaft engages the drum quill gear which drives the cable drum.

It is another object of the present invention to provide the cable drum with a free wheeling position that allows the cable to be payed out easily. This is accomplished by mounting the cable drum over a drum quill and providing a dead-bolt type latch that secures the drum to the drum quill or allows the drum to turn freely when the dead-bolt latch is withdrawn.

It is a still further object of the present invention that it may be used not only as a hunter's towing device, but also may be used as a motorized winch for various obvious applications.

Other objects and advantages will become apparent in the following specification when considered in light of the attached drawings.

DESCRIPTION OF THE PREFERRED EMBODIMENT

Figure 1:
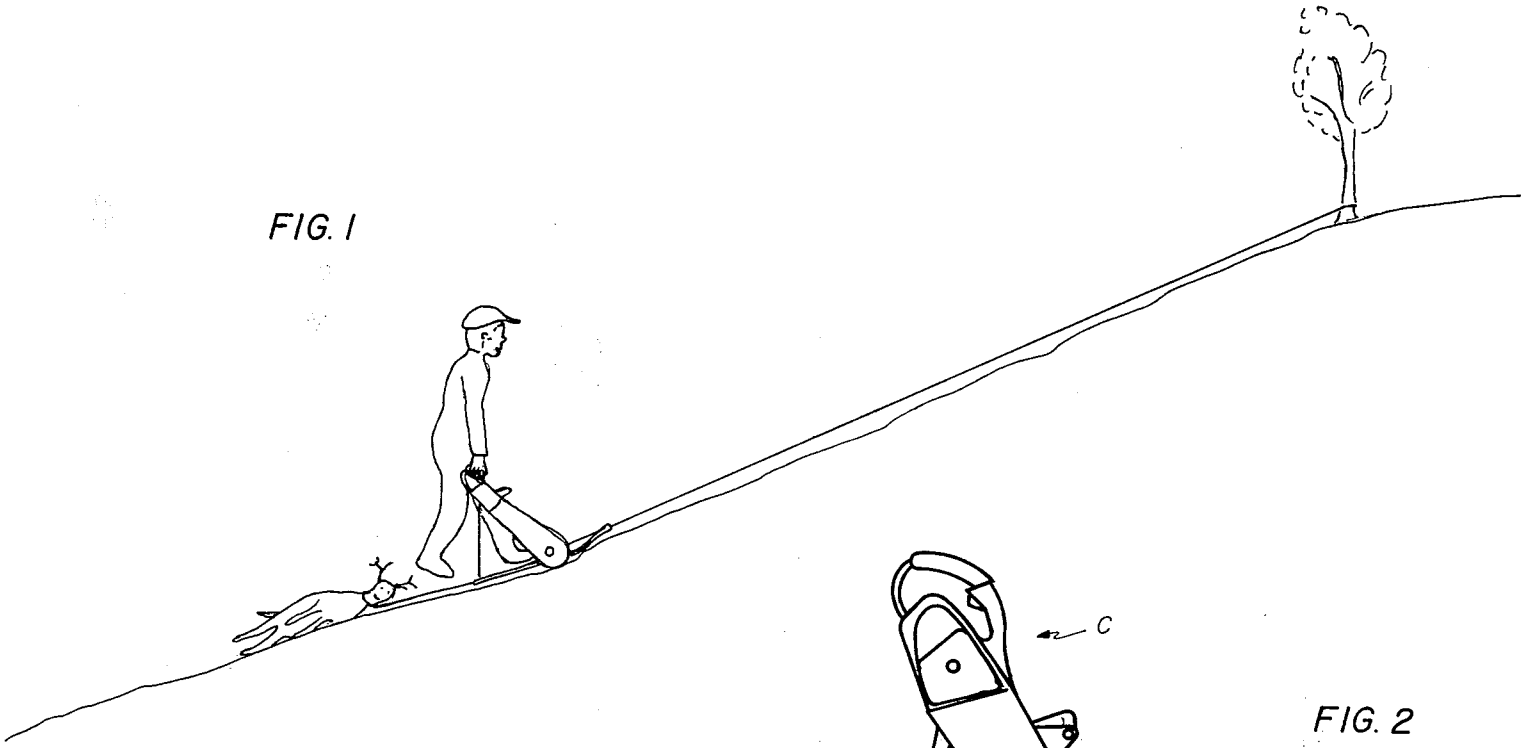
FIG. 1 is a sketch of a hunter employing the present invention to tow a deer.

Referring now to the drawings in detail, wherein like reference characters indicate like parts throughout the several figures, the reference numeral 10 generally refers to the towing adapter and the letter C refers generally to the chainsaw. A chain guide and mounting bar 11 replaces the normal chain guide bar on a chainsaw and mounts on the same bolts 12 that mount the normal chainsaw guide bar. The chain guide and mounting bar 11 provides a slotted track that directs a drive chain 40 to a drive sprocket 13. The drive sprocket 13 is also slotted and provided with a plurality of rolled pins 14 equally spaced around the perimeter of the drive sprocket. The rolled pins 14 engage crested teeth 41 of the drive chain 40. The mounting bar is affixed to a skid plate 56 with a series of bolts 57. The skid plate 56 also is affixed to a supporting back plate 32 of a gear case cover 30 in a like manner with a series of bolts thus forming a rigid frame for the machine. The drive sprocket 13 is affixed by a key way and a sprocket key 15 to a main shaft 16. The rotating main shaft 16 runs transversely through the center of a drum quill 35 and a cable drum 37 is supported on one end by a ball bearing 17 in the gear case cover 30 and on the other end by a ball bearing 17 mounted in the mounting bar 11, the shft protruding through the bearing sufficiently for the drive sprocket 13. This shaft also has two ball bearings 17 sufficiently spaced to support the drum quill 35. This allows the main shaft and the drum quill to turn at different speeds. The main shaft also has a spur pinion gear 18 affixed by a key way and key 19 which pinion gear is positioned by spacers 34. The drum quill bearing 17 at the opposite end of the main shaft near the drive sprocket 13 is positioned by a snap ring 20 and a spacer 21.

Figure 8:
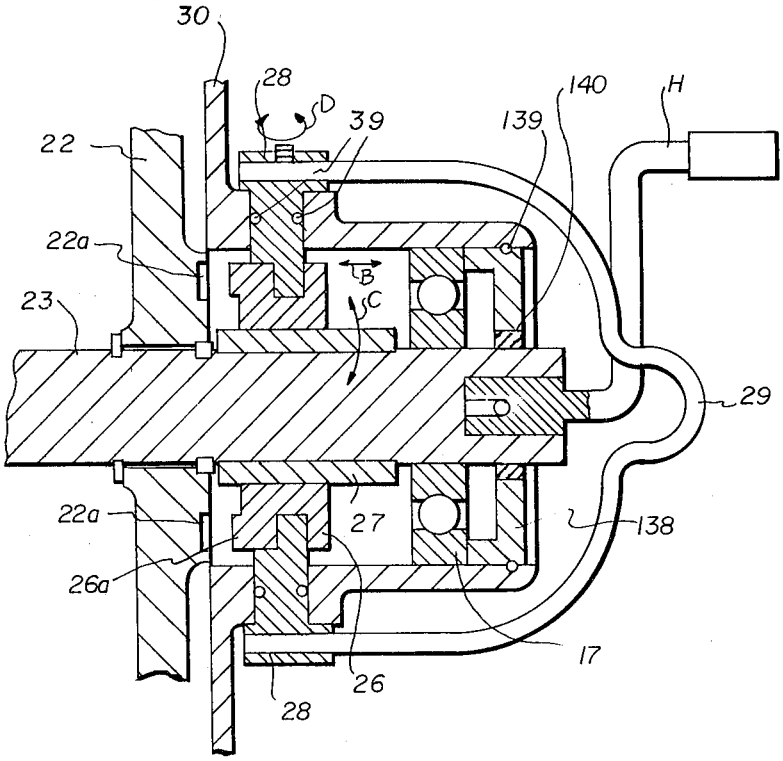
FIG. 8 is an enlarged view of a portion of FIG. 5, showing the clutch mechanism for engaging the drum.

The main shaft pinion gear 18 engages an intermediate spur gear 22 on an intermediate shaft 23. The intermediate shaft is supported by two ball bearings 17, one in the supporting back plate 32 and the other in the gear case cover 30, the intermediate spur gear 22 rides freely on the intermediate shaft until it is engaged by a lug type clutch 26. The clutch is axially slidable (arrow B) on the shaft 23 but always rotatably fastened by two stationary lug clutch keys 27 (arrow C). The lug clutch 26 is actuated by two eccentric type cams 28 protruding through each side of the necked wall portion on the gear cover 30 housing the clutch and is sealed by two O-ring type oil seals 39. A handle H is removeably attached to an end of shaft 23 for manual rotation thereof (FIG. 8).

Figure 5:
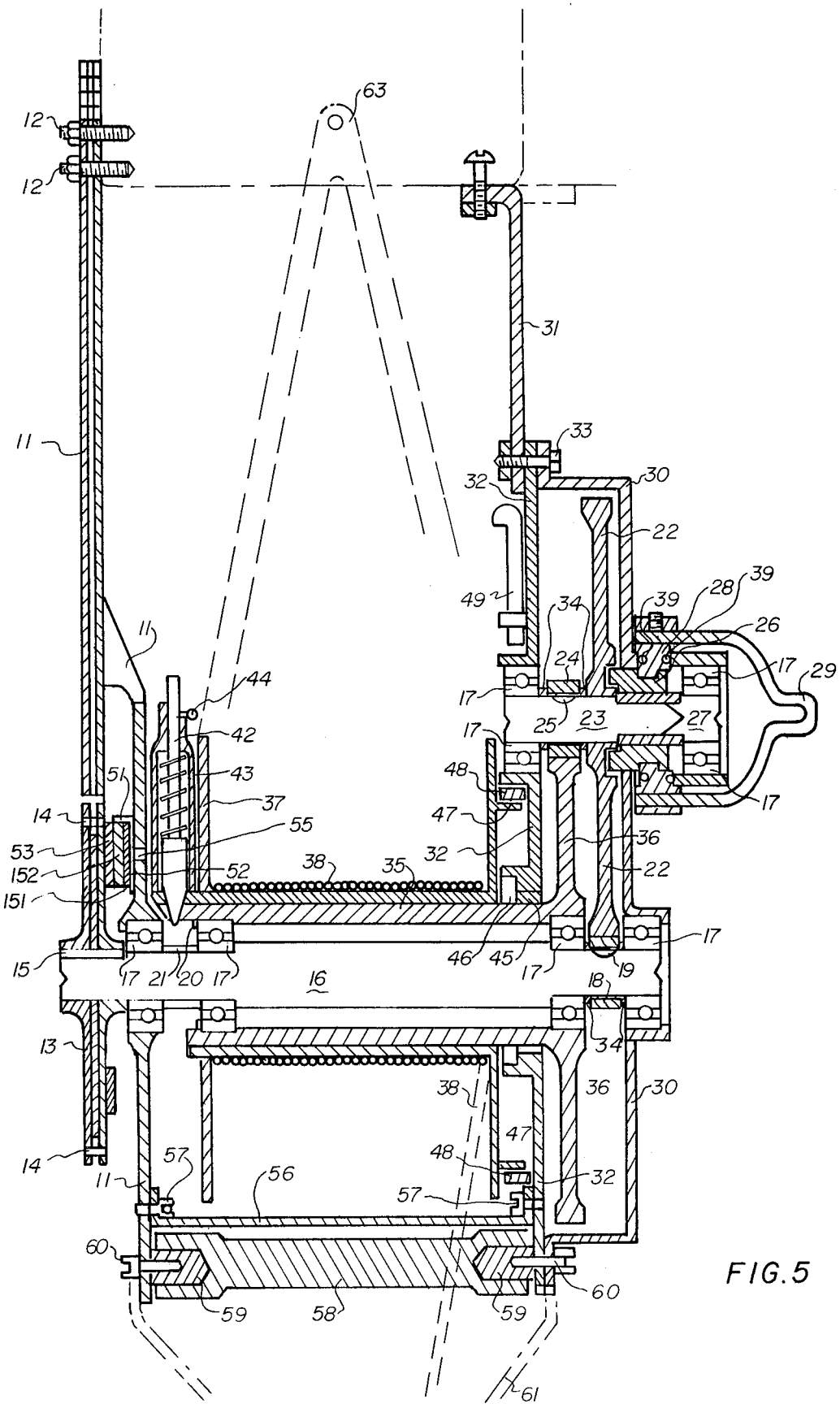
FIG. 5 is a top sectional view.

The cams 28 are controlled by a shifting lever 29. Moving the shifting lever 29 from one side to the other rotates the cams 28 180 degrees (arrow D) forcing the lug clutch 26 to move laterally (arrow B) on the intermediate shaft and engaging protrusions **26*a* on lug clutch 26 in the slots in the side of the intermediate spur gear 22. The intermediate spur gear 22 turns freely on the intermediate shaft 23 until engaged by the lug clutch 26 (FIG. 5) which fixes the intermediate spur gear 22 on the intermediate shaft 23 so that driving the intermediate spur gear also drives the intermediate shaft (arrow C). When the lug clutch 26 is disengaged (FIG. 8), the intermediate spur gear 22 simply rotates independently on the intermediate shaft 23**. The above described interaction of gears on the main shaft and the intermediate shaft allows the selection of a neutral position for the drive train, so that the chainsaw motor can be started, run and warmed up before engaging the drive train.

The gear cover 30 encases the gears and the lug clutch 26. It also supports the ends of both shafts and is bolted to the support backing plate 32 by a series of bolts with nuts 33 having a brace 31 affixed to the chainsaw. End cap 138 in combination with "O" ring 139 and oil seal 140 seal the gear cover 30 at an intermediate shaft 23 end.

An intermediate shaft pinion gear 24 is affixed to the intermediate shaft 23 by a key 25, and pinion gear 24 engages the drum quill gear 36 which is affixed to the drum quill 35 by welding or the like. The drum quill 35 protruding through the support plate 32 has a bushing type bearing 45 and an oil seal 46.

A cable drum 37 has a brake drum 47 protruding out from a flange on the cable drum on the gear case end and the cable drum 39 is wound with the cable 38 which rides on the drum quill 35 and is free to rotate on the quill until locked to the quill by a dead bolt type locking device 42 fused on a housing and welded on the cable drum 37 including a tension spring 43 and a positioning knob 44. Disengaging the dead bolt 42 and locking it in the withdrawn position with the positioning knob 44 allows the cable drum 37 to freewheel independent of the drum quill 35 so a desired length of cable can be payed out before engaging the drive train. When enough cable is payed out the dead bolt is released from the withdrawn position and the tension spring 43 will force the dead bolt to pop back in one of the lock holes in the drum quill 35 when next they register. Thus, the cable drum is reengaged with the drive train and rewinding of the cable may commence.

Figure 4:
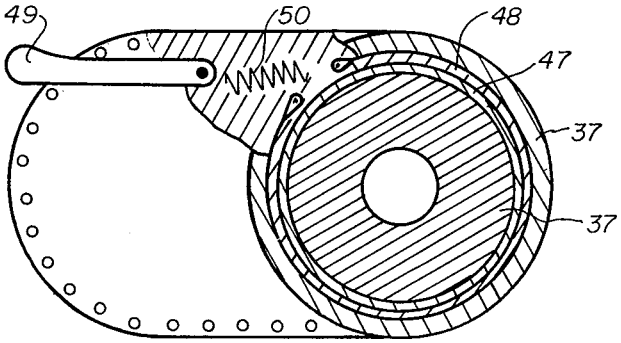
FIG. 4 is a side sectional view of the manual braking system.

The hunter's towing machine is provided with both a manual and an automatic braking system. The manual braking system utilizes a brake drum 47 located on the outside of the cable drum 37. A brake band 48 surrounds the brake drum 47 and is connected to a brake spring 50 which in turn is connected to a pivotally mounted brake lever 49 which actuates the brake system. This sequence is best shown in FIG. 4.

The automatic brake housing 51 is mounted on the mounting bar 11 with a special bolt 55 that is machined with an elongated head 155 protruding out toward the drive sprocket 13. This bolt also holds a wedge shaped roller backing plate 151 having a narrow upper end and optional space adjusting shims (not shown) and is mounted directly behind the drive sprocket 13.

Figure 6:
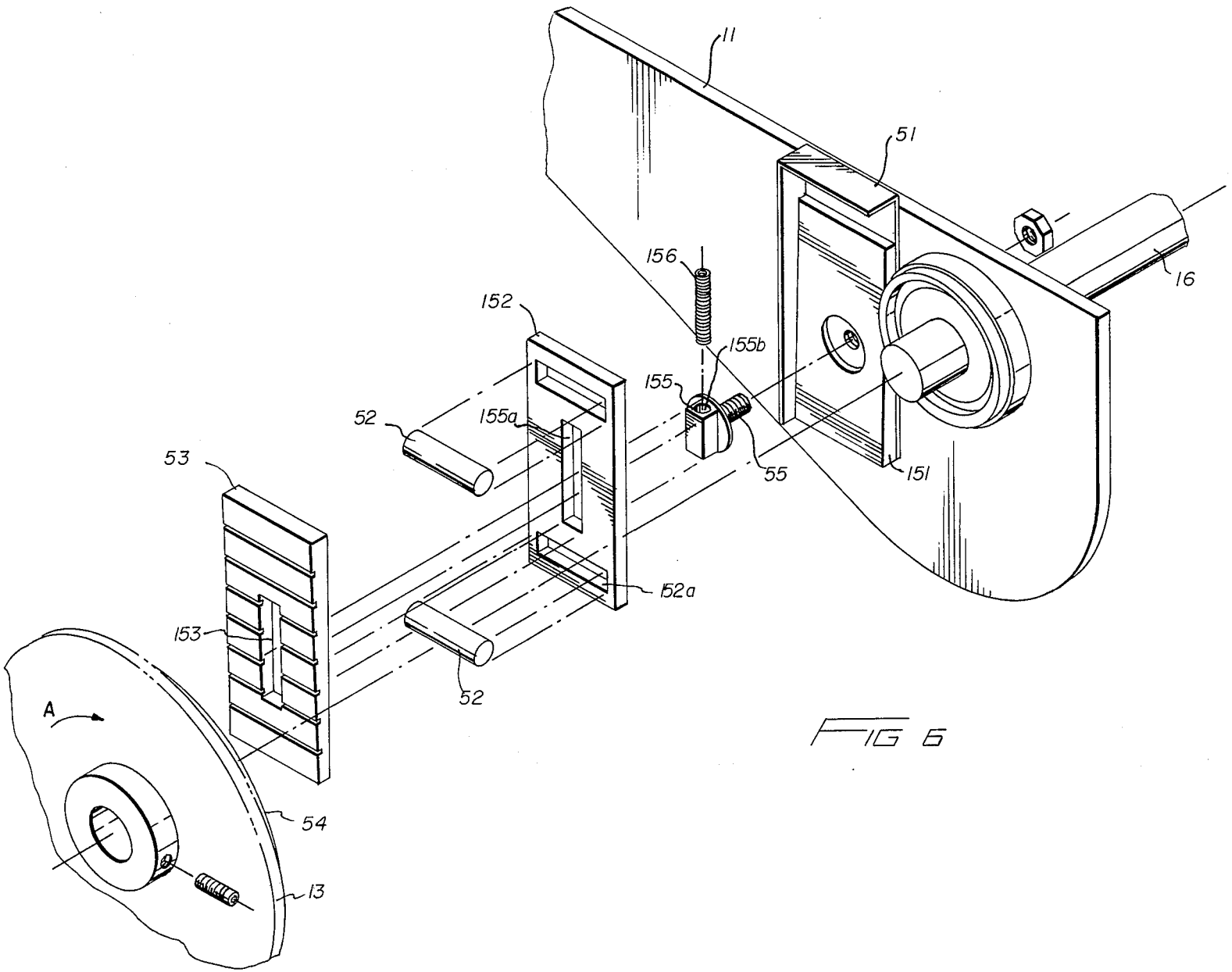
FIG. 6 is a perspective exploded view of the automatic braking system.

A roller retaining plate 152 having two rectangular holes **152*a* near each end receive rollers 52 that are at a right angle to the length of the plate. There also is an elongate hole 155*a* in the center of the plate running parallel with its length to fit over the oblong head 155 of the mounting bolt 55 thus allowing the plate 152 to move vertically up and down with the rollers. A hole 155*b* drilled in the top side of the mounting bolt head 155 forms a pocket for a small spring 156 to hold the plate 152 via hole 155*a* in an upward position. A wedge shaped brake puck 53 having a thickened upper portion and an elongate hole 153 in the center thereof fits over the oblong head 155 of the bolt 55 and thus is free to move up and down by the rollers 52 yet held in place by the head of the bolt and by a circular friction plate 54 which is mounted on the back side of the drive sprocket 13 by rivets. As long as the drive sprocket 13 is under power it turns in one direction only shown by arrow A which causes the friction plate 54 to move the wedge shaped brake puck 53 on the rollers 52 toward the top of the brake housing 51. Thus, the rollers moving on the tapered back plate 151 and the brake puck 53 being tapered also relieve the braking action of brake puck 53. However if the drive sprocket 13 tries to reverse direction which occurs when the chainsaw motor is idling or shut off and a load exists on the cable, then the friction plate 54 will move the brake puck 53 down on the rollers causing it to jam tight between the rollers and the friction plate 54 thus causing a braking action on the drive sprocket 13. This is compounded back through the gear train and will hold any load and thus it becomes an automatic brake. The automatic brake is best depicted in FIG. 6**.

Figure 2:
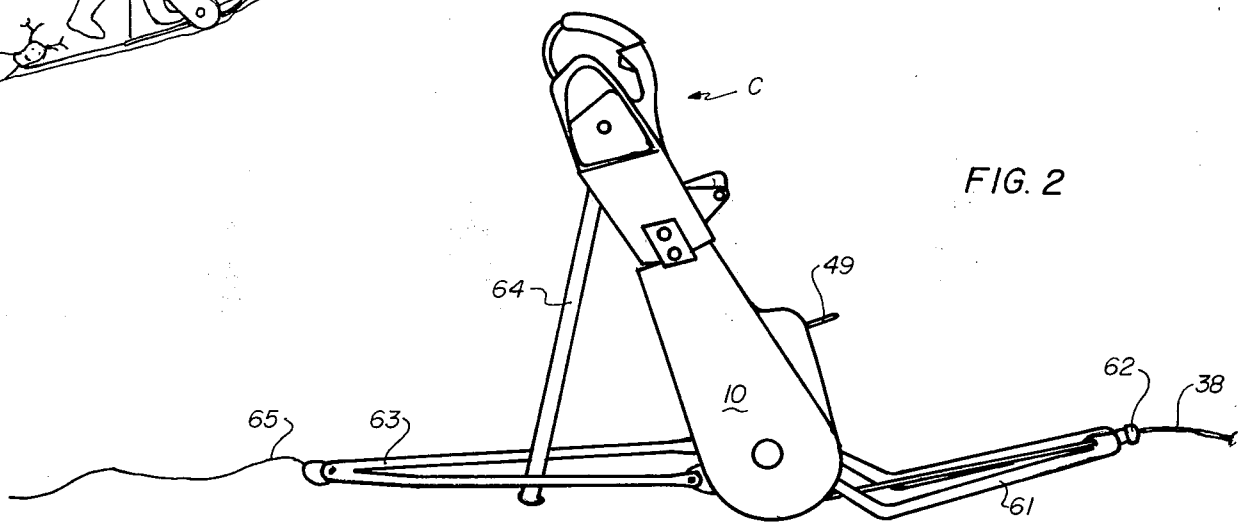
FIG. 2 is a perspective side view of the present invention.
Figure 3:
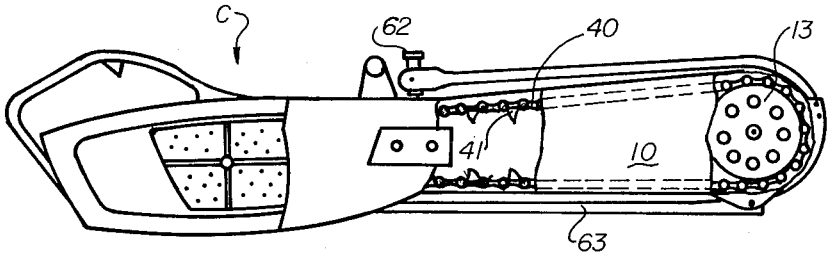
FIG. 3 is a side cutaway view of the towing adapter connected to a chainsaw with the tow bar and the front cable guide bar in the retracted, portable position.
Figure 7:
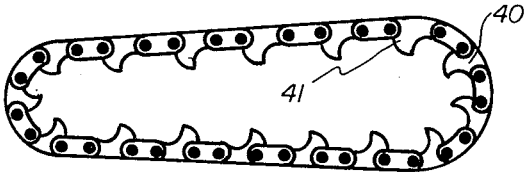
FIG. 7 is a side view of the drive chain.

The bottom plate skid pan and brace 56 is bolted between the furthest extremity of the chain guide mounting bar 11 and the support plate 32 by a series of allen-head bolts 57. Just above the skid pan 56 and mounted to the same structural members are cable guide rollers 58 which helps pay out and retrieve the cable evenly. The cable guide roller 58 is mounted with allen head bolts 60 and rotates on axles 59. Extending in front of the cable guide roller 58 is the front cable guide bar 61, which pivotally mounts the front cable guide bushing 62 through which the cable runs. A tow bar 63, to which is connected the tow line 65, extends to the rear of the machine about the same distance that the front cable guide bar extends in front of the machine, as shown in FIG. 2. A stabilizer bar 64 extends from the upper body of the chainsaw to the ground behind the machine in order to prop up the machine in a standing position when stopped. All three extending bars, the stabilizer bar 64, the tow bar 63, and the front cable guide bar 61, are pivotally mounted and fold up close to the body of the machine to make it more portable, as shown in FIG. 3.

Having thus described the preferred embodiment of the invention it should be understood that numerous structural modifications and adaptations may be resorted to without departing from the spirit of the invention.

What is claimed:

1. A towing machine for taking up cable and powered by a chainsaw or the like comprising in combination:

an elongate housing connected to the chainsaw, a main shaft extending transversely through said housing, supported in said housing with bearings, a drive sprocket connected to said main shaft at an extremity thereof outside of said housing, chain means extending from the chainsaw to said drive sprocket to rotate said shaft, a cable drum carried on a drum quill within said housing, means disposed between said cable drum and said main shaft to selectively rotate said cable drum to thereby take up the cable under power, and first and second braking means for stopping said cable drum, said first braking means manually operable, said second braking means allowing only unidirectional motion, wherein said means for selectively rotating said cable drum comprises: an intermediate shaft supported in said housing on bearings, an intermediate spur gear interconnecting said intermediate shaft to said main shaft, a pinion gear on said intermediate shaft, and said drum quill having a gear portion to mesh with said pinion gear and fixedly drive said cable drum, and clutch means to selectively engage said main shaft to said drum quill including freewheeling means connecting said cable drum to said drum quill frame whereby when retracted, said cable drum is dissociated from said drum and can pay out cable free of said means to selectively rotate said cable drum.

2. The device of claim 1 further including a cable guide fastened to said housing to guide said cable.

3. The device of claim 1 wherein said clutch means includes a lug type clutch being disposed about said intermediate shaft rotatively fixed by two driving keys embedded in said intermediate shaft and said clutch being axially translatable thereon, said clutch being axially moved by two eccentric cams protruding through the sides of the gear case which are sealed by O-ring type oil seals, said cams rotated by actuating a bail type shifting handle, whereby said handle selectively engages lugs of said lug clutch with slots on a side of said intermediate spur gear.

4. The device of claim 3 wherein said first braking means comprises a lever pivoted to a support plate on said housing, a brake drum disposed on said main shaft, a brake lining and band fixed at one end and overlying said brake drum connected to said lever through a spring at another end so that pivoting said lever engages the brake.

5. The device of claim 4 wherein said freewheeling means comprises a pair of openings on said cable drum and drum quill adapted for coregistry, a locking bolt oriented for insertion into said openings, whereby when said locking bolt is not inserted said cable drum can pay out cable without rotating said drum quill.

6. The device of claim 1 wherein said housing is provided with a pivoted tow bar for affixing an object to be towed thereto.

7. The device of claim 5 wherein said housing carries an upper and lower chain guide between the chainsaw and drive sprocket, a shroud overlies said chain guide and drive sprocket, a skid pan forms a bottom face of said housing, and said means for selectively rotating said cable drum, said locking bolt, said brake lever and said clutch handle extending out from said housing.

8. The device of claim 7 wherein said second braking means comprises a friction disc on said main shaft drive sprocket inner surface, a wedge shaped friction puck slideably disposed on said housing through rollers on one side thereof opposite said friction disc whereby powered rotation of said drive sprocket in one direction rolls said wedge shaped friction puck away from engagement against said friction disc while rotation in the other direction causes said wedge shaped friction puck to brake.

* * * * *